US009130322B2

(12) United States Patent
Hsu

(10) Patent No.: US 9,130,322 B2
(45) Date of Patent: Sep. 8, 2015

(54) ELECTRICAL CONNECTOR ASSEMBLY WITH AN ADAPTER ASSEMBLED THEREOF

(71) Applicant: HON HAI PRECISION INDUSTRY CO., LTD., New Taipei (TW)

(72) Inventor: Shuo-Hsiu Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 98 days.

(21) Appl. No.: 14/083,371

(22) Filed: Nov. 18, 2013

(65) Prior Publication Data

US 2014/0141628 A1 May 22, 2014

(30) Foreign Application Priority Data

Nov. 16, 2012 (TW) ..... 101222169

(51) Int. Cl.

| | |
|---|---|
| ***H01R 12/00*** | (2006.01) |
| ***H01R 12/71*** | (2011.01) |
| ***H01R 12/70*** | (2011.01) |
| ***H01R 12/79*** | (2011.01) |

(52) U.S. Cl.

CPC ..... *H01R 12/712* (2013.01); *H01R 12/7082* (2013.01); *H01R 12/79* (2013.01)

(58) Field of Classification Search

CPC ..... H01R 12/79; H01R 12/62; H01R 12/52; H01R 23/66; H01R 12/61; H01R 12/78; H01R 13/22; H01R 23/72; H01R 9/096; H01R 4/48

See application file for complete search history.

(56) References Cited

U.S. PATENT DOCUMENTS 5,137,462 A * 8/1992 Casey et al. ..... 439/74
8,197,262 B2 * 6/2012 Nguyen et al. ..... 439/74

FOREIGN PATENT DOCUMENTS

TW M429188 5/2012

* cited by examiner

*Primary Examiner* — Xuong Chung Trans
(74) *Attorney, Agent, or Firm* — Wei Te Chung; Ming Chieh Chang

(57) ABSTRACT

An electrical connector assembly includes a first electrical connector, a second electrical connector and an adapter assembled between the first and second electrical connector. The first electrical connector includes a first insulating housing and a plurality of first contacts received in the first insulating housing. The second electrical connector includes a second insulating housing and a plurality of second contacts received in the second insulating housing. The adapter includes a base and a plurality of pin contacts retained in the base, the pin contacts run through the base and contact the first and second contacts simultaneously.

10 Claims, 8 Drawing Sheets

ELECTRICAL CONNECTOR ASSEMBLY WITH AN ADAPTER ASSEMBLED THEREOF

BACKGROUND OF THE INVENTION

1. Field of the invention

The present disclosure relates to an electrical connector assembly, and more particularly to an electrical connector assembly connecting a central processing unit (CPU) with a flexible printed circuit (FPC).

2. Description of related art

TW patent number M429188 issued to HSU, SHUO HSIU on May 11, 2012 discloses an electrical connector assembly. The electrical connector assembly comprises a first electrical connector soldered on a CPU and a second electrical connector soldered on an FPC. The first electrical connector comprises a first insulating housing and a plurality of first contacts received in the first insulating housing. The second electrical connector comprises a second insulating housing and a plurality of second contacts received in the second insulating housing. The first contacts are pin contacts while the second contacts comprise contacting arms for inserted by the pin contacts so as to establish an electrical connection between the CPU and the FPC.

However, as the pin contacts are directly soldered on the CPU, on one hand, it is difficult to remove and change the first electrical connector when the pin contacts are damaged. On the other hand, as a soldering surface of the pin contact is very small, the soldering force is not enough and easy to be destroyed so that the electrical connection therebetween is unreliable.

In view of the above, an improved electrical connector assembly is desired to overcome the problems mentioned above.

SUMMARY OF THE INVENTION

Accordingly, an object of the present disclosure is to provide an electrical connector assembly with an adapter which is easy to be removed and changed.

According to one aspect of the present disclosure, an electrical connector assembly is provided for electrically connecting an electronic component with a flexible printed circuit (FPC). The electrical connector assembly comprises a first electrical connector, a second electrical connector and an adapter assembled between the first and second electrical connectors. The first electrical connector comprises a first insulating housing and a plurality of first contacts received in the first insulating housing. The second electrical connector comprises a second insulating housing and a plurality of second contacts received in the second insulating housing. The adapter comprises a base and a plurality of pin contacts retained in the base, the pin contacts run through the base and contact the first and second contacts simultaneously.

Other objects, advantages and novel features of the disclosure will become more apparent from the following detailed description when taken in conjunction with the accompanying drawings, in which:

DETAILED DESCRIPTION OF THE INVENTION

Reference will now be made to the drawings to describe the preferred embodiment of the present disclosure in detail.

Referring to FIG. 1 to FIG. 6, an electrical connector assembly 100 for electrically connecting a CPU 200 to an FPC 300, comprises a first electrical connector 1 assembled on the CPU 200, a second electrical connector 2 assembled on the FPC 300, and an adapter 3 assembled between the first electrical connector 1 and the second electrical connector 2.

Figure 1:
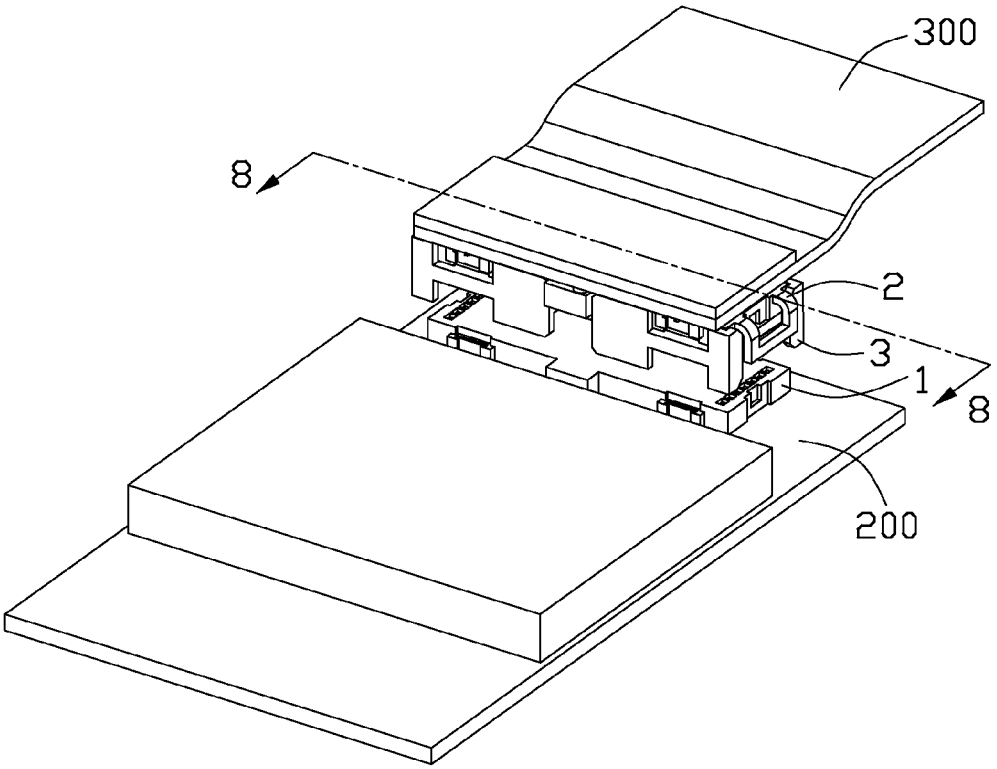
FIG. 1 is an assembled, perspective view of an electrical connector assembly with a CPU and a FPC in accordance with a preferred embodiment of the present disclosure.
Figure 2:
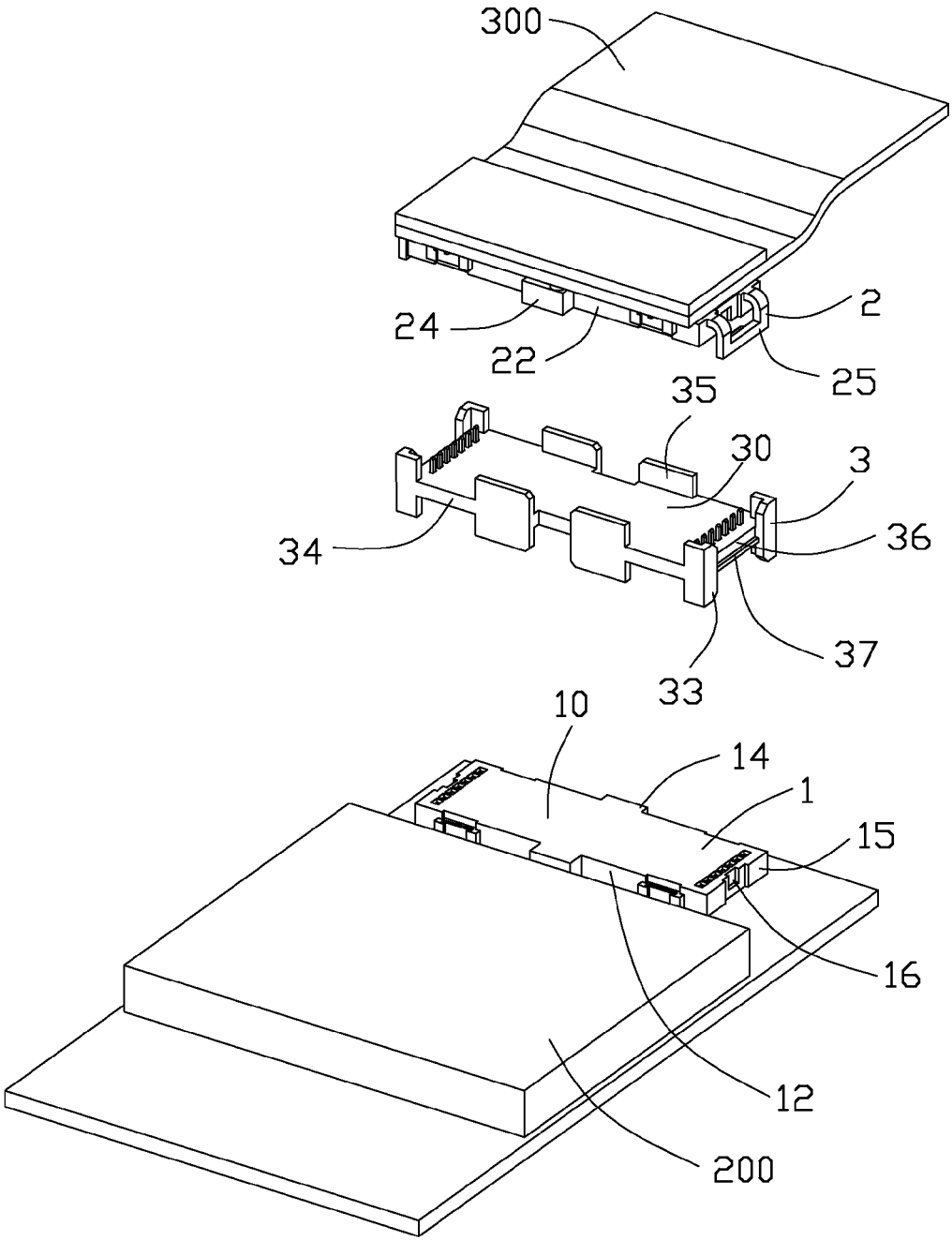
FIG. 2 is an exploded, perspective view of the electrical connector assembly shown in FIG. 1, wherein a first electrical connector connecting the CPU, a second electrical connector connecting the FPC.
Figure 3:
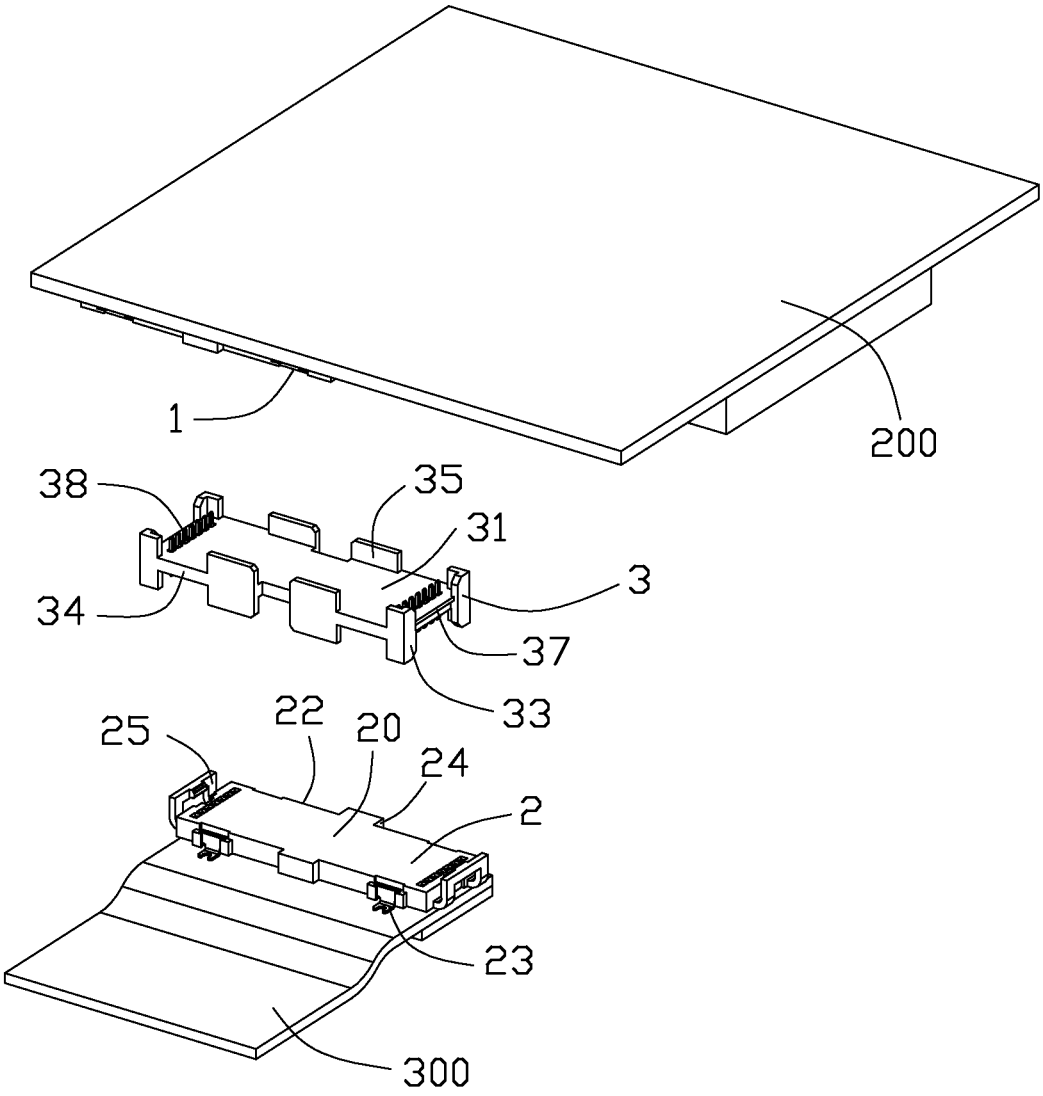
FIG. 3 is another view of the electrical connector assembly shown in FIG. 2.
Figure 4:
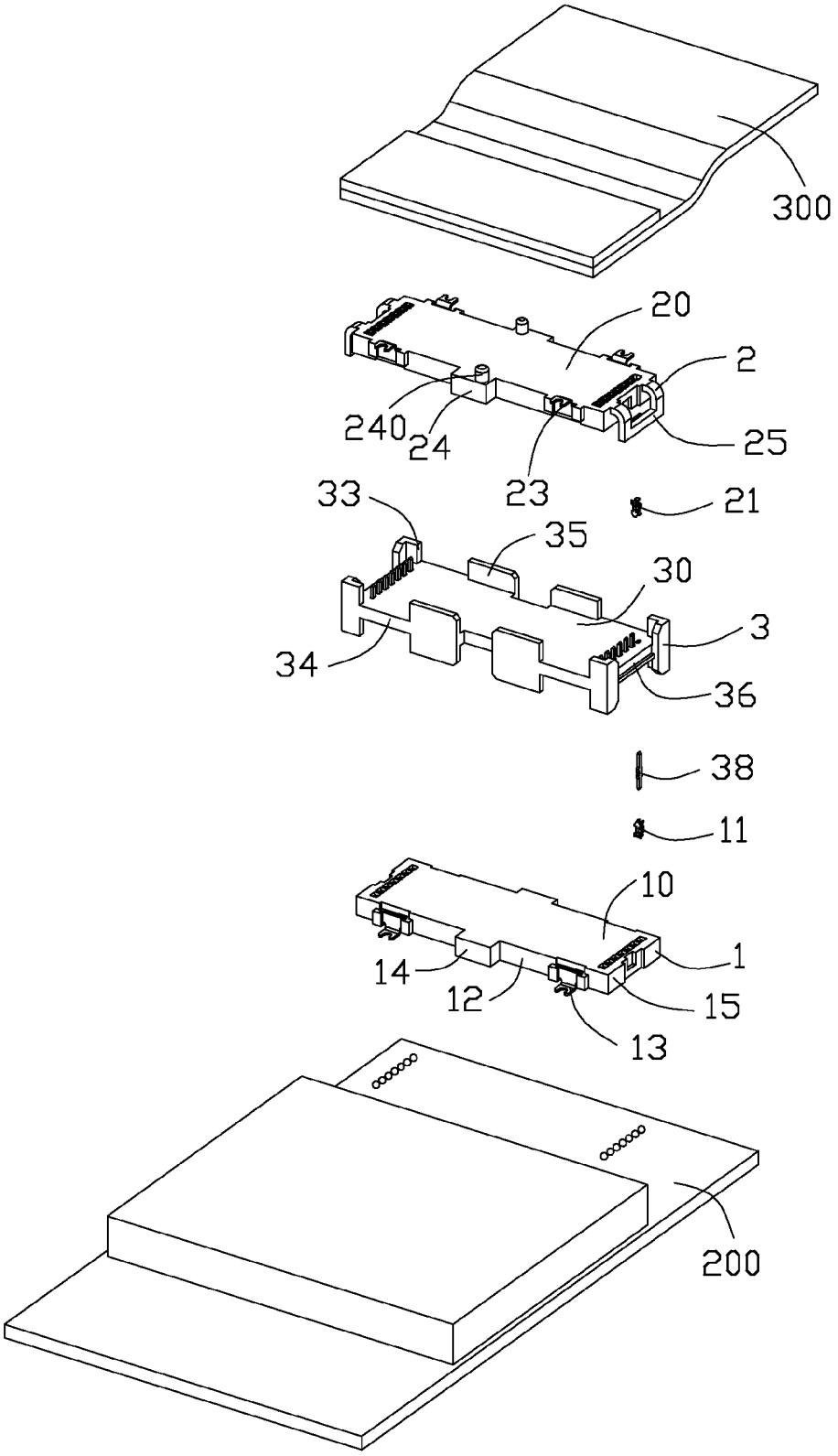
FIG. 4 is a view similar to the FIG. 2, wherein the electrical connector assembly, the CPU and the FPC are separated from each other.
Figure 5:
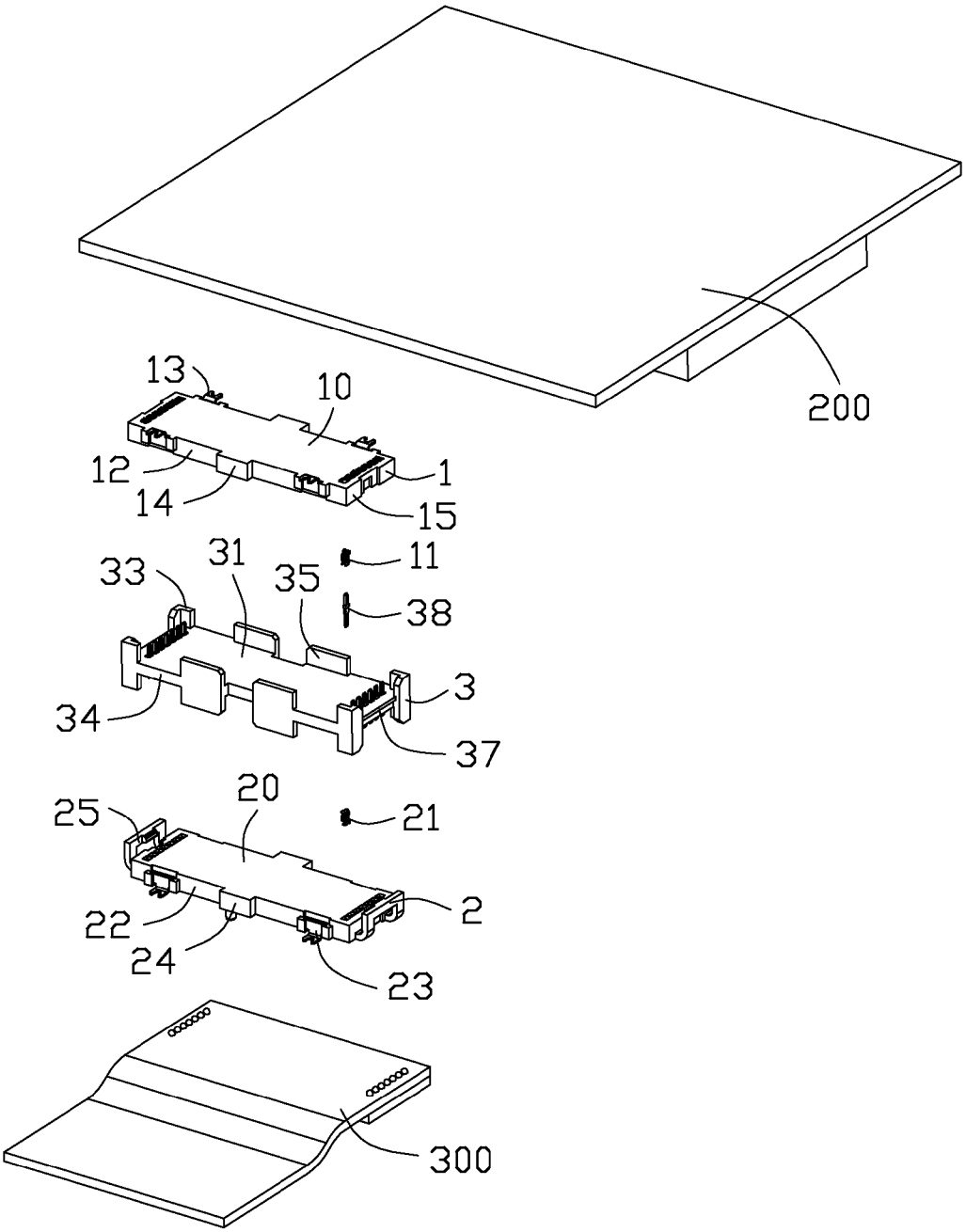
FIG. 5 is another view of the electrical connector assembly shown in FIG. 4.
Figure 6:
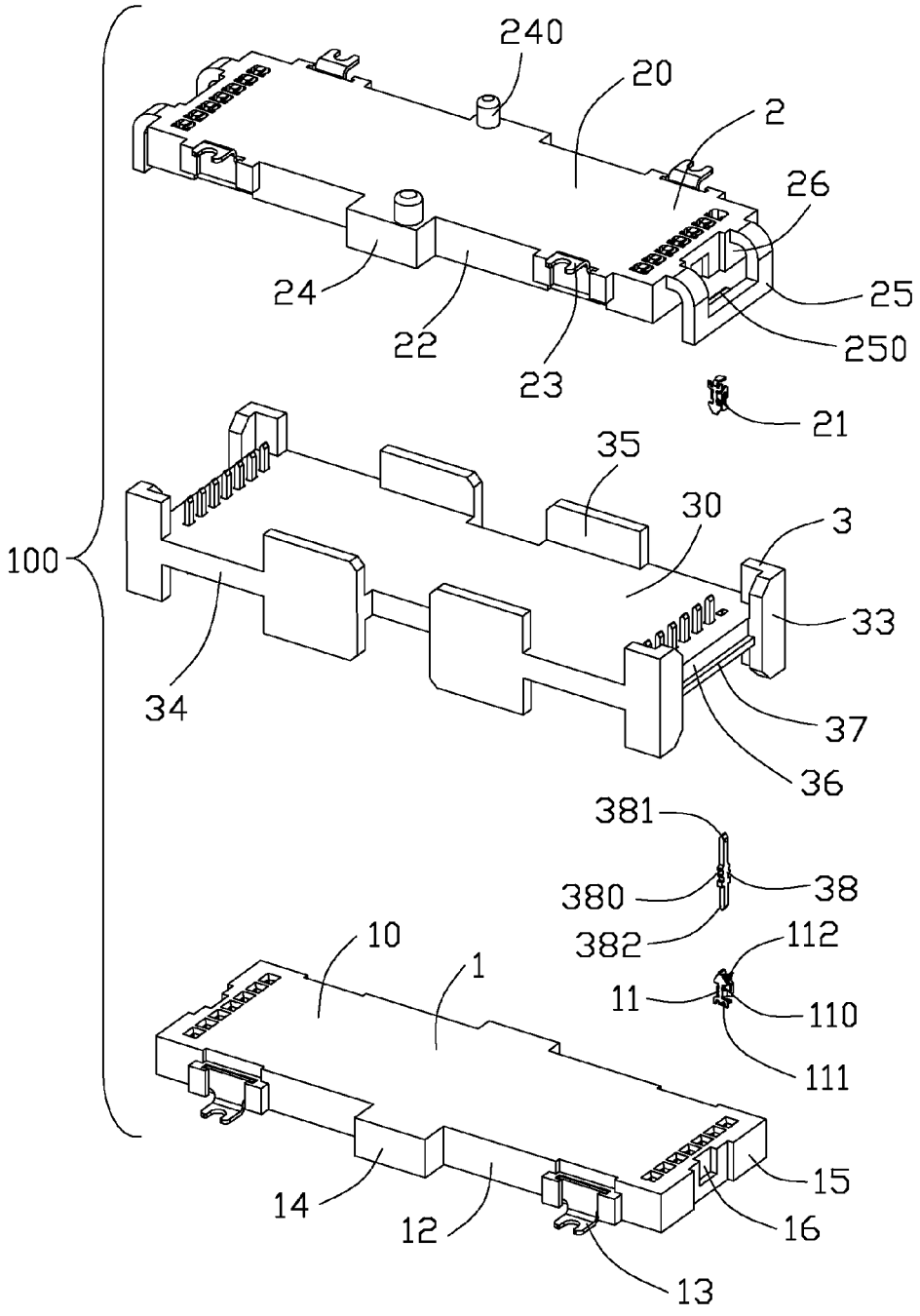
FIG. 6 is an exploded, perspective view of the electrical connector assembly shown in FIG. 4.
Figure 7:
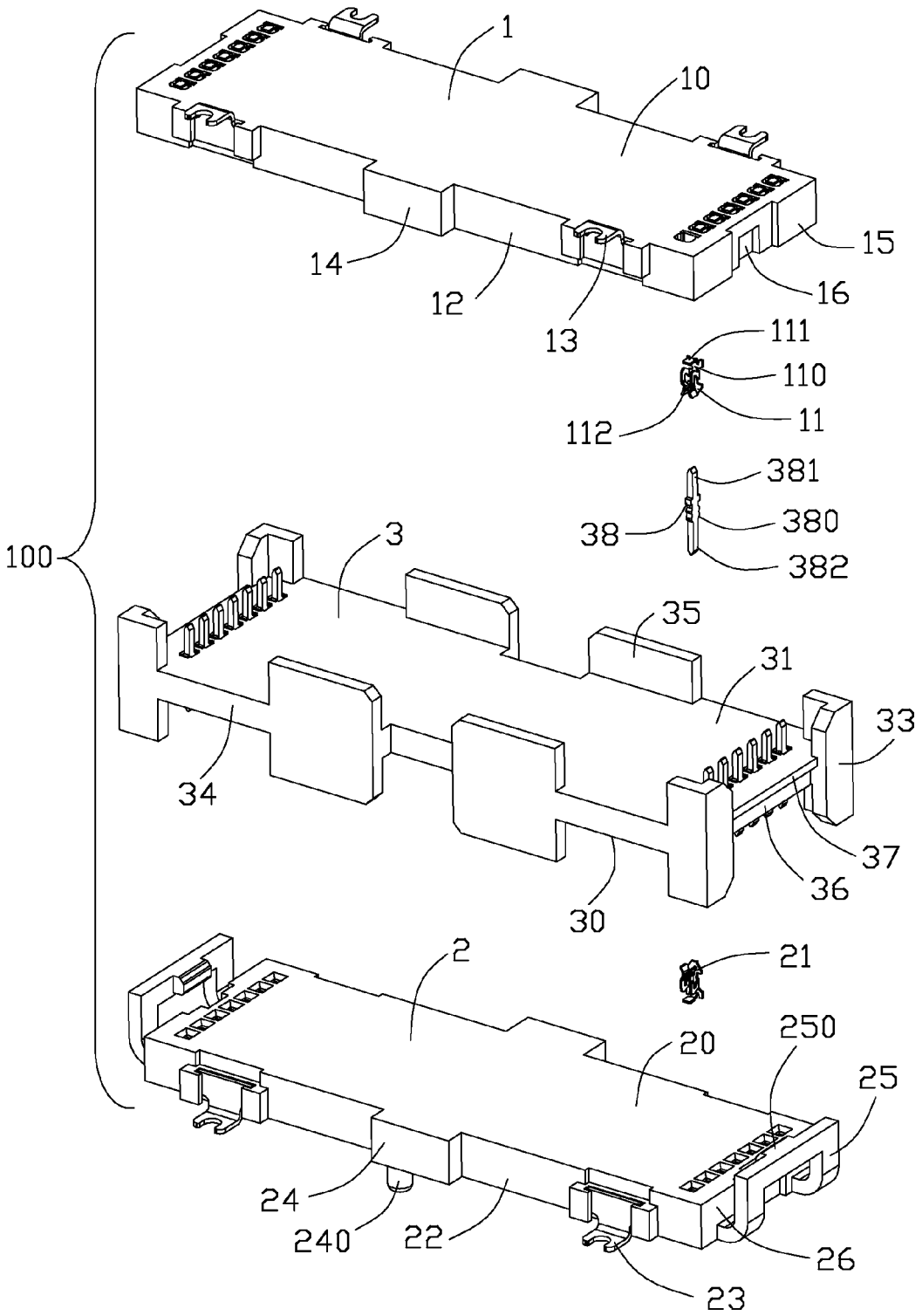
FIG. 7 is another view of the electrical connector assembly shown in FIG. 6.

Referring to FIGS. 6 and 7, the first electrical connector 1 is mounted on the CPU 200. The first electrical connector 1 comprises a first insulating housing 10, a plurality of first contacts 11 received in the first insulating housing 10, and a plurality of metal ears 13 assembled on the first insulating housing 10. The first insulating housing 10 is configured with a rectangular shape comprising a pair of lengthwise sides 12 and a pair of width sides 15 perpendicular to the lengthwise sides 12. The first insulating housing 10 further comprises a pair of protrusions 14 extending outwardly from the lengthwise sides 12. A pair of recesses 16 is defined on the width sides 15.

The second electrical connector 2 is mounted on the FPC 300. The second electrical connector 2 comprises a second insulating housing 20, a plurality of second contacts 21 received in the second insulating housing 20, and a plurality of metal ears 23. The second insulating housing 20 has a profile similar to the first insulating housing 10, comprising a pair of lengthwise sides 22 and a pair of width sides 26 perpendicular to the lengthwise sides 22. The second insulating housing 20 comprises a pair of protrusions 24 extending outwardly from the lengthwise sides 22 corresponding to the protrusion 14 of the first insulating housing 10. The second insulating housing 20 comprises a pair of latches 25 extending downwardly from the width sides 26. The latch 25 comprises a hook 250 for engaging with the adapter 3.

The first contact 11 comprises a plated body portion 110, a soldering portion 111 extending downwardly from the body portion 110 for mounting on the CPU 200, and a pair of contacting arms 112 extending from two opposite ends of the body portion 110 for electrically contacting the adapter 3. The contacting arm 112 of the first contact 11 is completely accommodated in the first insulating housing 10 having no portion extending beyond the surface of the first insulating housing 10. Thus, the first contact 11 can be well protected. In the preferred embodiment of the present disclosure, the second contact 21 has the same structure with the first contact 11, and the arrangement of the second contact 21 in the second insulating housing 20 is similar to the first contact 11 in the first insulating housing 10. The second contact 21 is mounted on the FPC 300. The first contact 11 and the second contact 21 are stamped and bent from a metal sheet.

Figure 8:
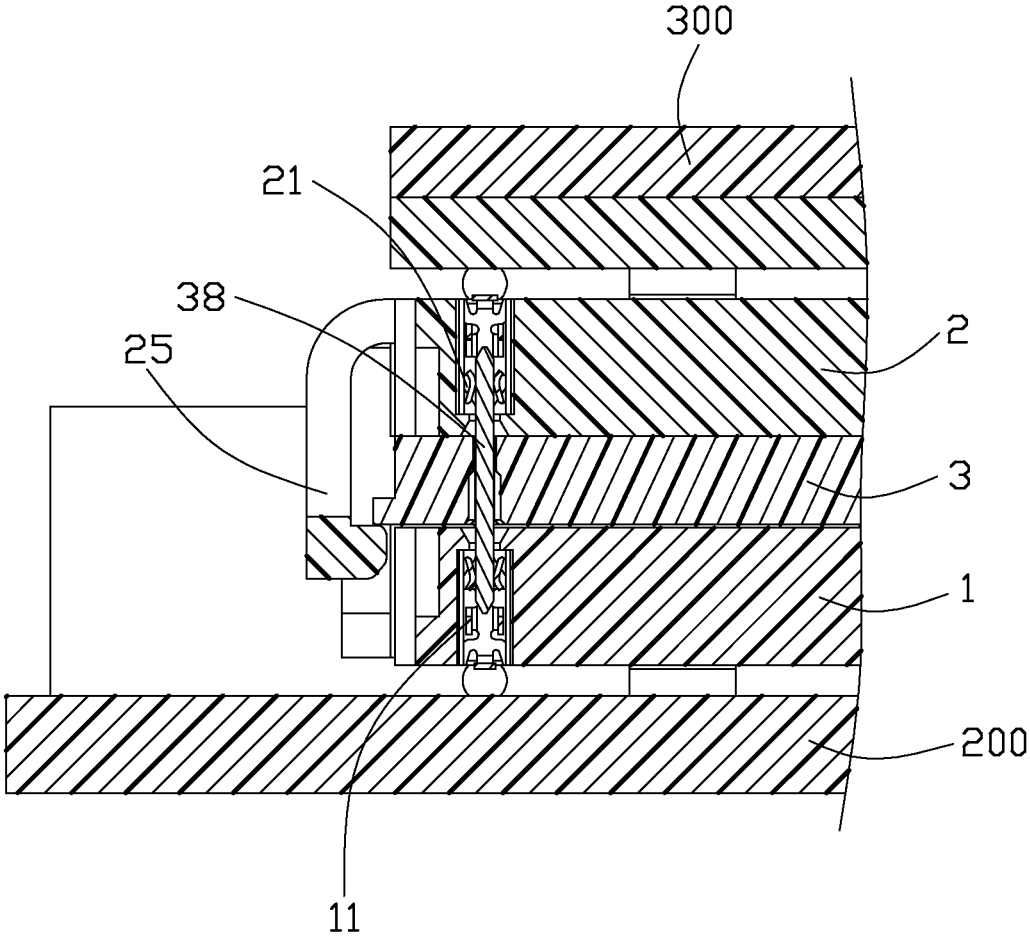
FIG. 8 is a sectional view of the electrical connector shown in FIG. 1 along line 8-8.

Referring to FIGS. 6 to 8, the adapter 3 is assembled between the first electrical connector 1 and the second electrical connector 2. The adapter 3 comprises a base and a plurality of pin contacts 38 retained in the base. The base defines a top surface 30 for supporting the second electrical connector 2 and a bottom surface 31 opposite to the top surface 30 for abutting against the first electrical connector 1. The adapter 3 further comprises a plurality of walls extending vertically towards two opposite directions from the base. The walls together with the top surface 30 of the base define an upper cavity for receiving the second electrical connector 2 while the walls together with the bottom surface 31 of the base define a lower cavity for receiving the first electrical connector 1. The walls are discrete further defining four position walls 33 on the corners of the base and a plurality of side walls 35 on two lengthwise sides 34 of the base. The base comprises a pair of tabs 37 extending outwardly from two width sides 36 of the base.

The pin contact 38 is liner and rotational symmetric. The pin contact 38 comprises a retention portion 380 retaining on the base, an upper contacting portion 381 extending upwardly from the retention portion 380 and beyond the top surface 30 of the base, and a lower contacting portion 382 extending downwardly from the retention portion 380 and beyond the bottom surface 31 of the base. The upper contacting portion 381 extends into the upper cavity for contacting the second contact 21 of the second electrical connector 2 while the lower contacting portion 382 extends into the lower cavity for contacting the first contact 11 of the first electrical connector 1.

Referring to FIG. 6 and FIG. 8, when assembling, the first electrical connector 1 together with the CPU is assembled into the lower cavity of the adapter 3 in an up-to-down direction, the lower contacting portion 382 of the pin contact 38 inserts into the first contact 11 and contacts the contacting arms 112, the protrusions 14 of the first electrical connector 1 locate between two adjacent side walls 35 and under the bottom surface 31 of the base; the second electrical connector 2 together with the FPC is assembled into the upper cavity of the adapter 3 in the up-to-down direction, the upper contacting portion 381 of the pin contact 38 inserts into the second contact 21 and contacts with the contacting arms of the second contact 21, the protrusions 24 of the second electrical connector 2 corresponding to the protrusion 14 of the first electrical connector 1 locate between two side walls 35 and above the top surface 30 of the base. The hook 250 of the latch 25 engages the tab 37 to retain the second electrical connector 2 on the adapter 3. Thus, the first and second electrical connectors 1, 2 are electrically connected by the adapter 3.

According to the above described embodiment of the present disclosure, an electrical connector assembly 100 with a pin-pin adapter 3 is provided. In this embodiment of the present disclosure, the first and second contacts 11, 21 of the first and second electrical connectors 1, 2 are hidden in the first and second insulating housings 10, 20, thus the risk of damaging the contacts is decreased. And, the soldering portion of the first and second contacts can be designed larger than the pin contact so as to ensure the welding quality. Another aspect, the structure of the adapter 3 is simple and easy to be manufactured. The adapter 3 can be removed and changed easily if the pin contacts 38 are damaged rather than change the electrical connector together with the CPU or the FPC.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector assembly comprising:

a first electrical connector comprising a first insulating housing and a plurality of first contacts received in the first insulating housing;

a second electrical connector electrically connecting the first electrical connector in an up-to-down direction, the second electrical connector comprising a second insulating housing and a plurality of second contacts received in the second insulating housing; and an adapter assembled between the first electrical connector and the second electrical connector, the adapter comprising a base and a plurality of pin contacts retained in the base, the pin contacts running through the base in the up-to-down direction and contacting the first and second contacts simultaneously; wherein the adapter comprises a plurality of position walls on the corners of the base, the position wall defines one section extending upwardly from the base and another section extending downwardly from the base; wherein the adapter comprises a plurality of side walls on two lengthwise sides of the base, the side wall defines one section extending upwardly from the base and another section extending downwardly from the base; wherein the first and second electrical connectors comprise a plurality of protrusions extending outwardly from two lengthwise sides of the first and second insulating housings, the protrusions are positioned between two adjacent side walls of the base.

2. The electrical connector assembly as claimed in claim 1, wherein the base comprises a top surface supporting the second electrical connector and a bottom surface abutting against the first electrical connector.

3. The electrical connector assembly as claimed in claim 2, wherein the pin contact comprises a retention portion retaining on the base, an upper contacting portion extending upwardly from the retention portion and beyond the top surface of the base, and a lower contacting portion extending downwardly from the retention portion and beyond the bottom surface of the base.

4. The electrical connector assembly as claimed in claim 3, wherein the structures of the first and second contacts are the same, each of the first and second contacts comprises a soldering portion and a pair of contacting arms for accommodating the upper or lower contacting portion of the pin contact.

5. The electrical connector assembly as claimed in claim 1, wherein the second electrical connector comprises a pair of posts extending upwardly from the protrusions of the second insulating housing.

6. The electrical connector assembly as claimed in claim 1, wherein the second electrical connector comprises a latch extending downwardly from a width side of the second insulating housing while the adapter comprises a tab extending outwardly from the base corresponding to the latch, the latch engages with the tab.

7. The electrical connector assembly as claimed in claim 1, wherein the pin contact is liner and rotational symmetric.

8. An electrical connector assembly for connecting a CPU with an FPC comprising: a first electrical connector for connecting with the CPU, the first electrical connector comprising a first insulating housing and a plurality of first contacts received in the first insulating housing; a second electrical connector for connecting with the FPC, the second electrical connector comprising a second insulating housing and a plurality of second contacts received in the second insulating housing; and an adapter assembled between the first electrical connector and the second electrical connector, the adapter comprising a base, a plurality of walls extending towards two opposite directions from the base, and a plurality of pin contacts retained in the base, wherein the base together with the walls defines two cavities for accommodating the first and second electrical connectors, the pin contact extends into said two cavities to contact the first and second contacts; wherein the structures of the first and second contacts are the same, each of the first and second contacts comprises a soldering portion soldering with the CPU or FPC and a pair of contacting arms for being inserted by the in contact; wherein the walls of the adapter are discrete, the first and second electrical connectors comprise protrusions locating between two adjacent walls of the adapter; wherein the second electrical connector comprises a latch extending downwardly from the second insulating housing while the adapter comprises a tab extending outwardly from the base corresponding to the latch, the latch engages with the tab.

9. The electrical connector assembly as claimed in claim 8, wherein the pin contact is rotational symmetric.

10. An electrical connector assembly comprising:

an adaptor sandwiched between opposite upper connector and lower connector in a vertical direction;

the upper connector mounted to an FPC (Flexible Printed Circuit) and defining an insulative upper housing with a plurality of upper contacts therein;

the lower connector mounted to a CPU board and defining an insulative lower hosing with a plurality of lower contacts therein;

said adaptor defining an insulative middle housing with therein a plurality of pin type contacts in array, each of said pin type contacts defining an upper section mechanically and electrically connected to the corresponding upper contacts, respectively, and a lower section mechanically and electrically connected to the corresponding lower contacts, respectively; wherein said adaptor is only restrained between the upper connector and the lower connector without directly mounting to any other printed circuit board so as to be in a removable/replaceable manner; wherein the middle housing defines a plurality of side walls surrounding the upper housing and the lower housing, respectively; wherein one of the upper housing and the middle housing includes a deflectable locking arm to latch the other; wherein the upper housing and lower housing, each forms a protrusion snugly located between corresponding two of said side walls along a lengthwise direction of the upper housing and lower housing.

* * * * *